US009244434B2

(12) United States Patent
Stranczl et al.

(10) Patent No.: US 9,244,434 B2
(45) **Date of Patent: *Jan. 26, 2016**

(54) INSEPARABLE SINGLE-PIECE TIMEPIECE COMPONENT

(71) Applicant: Nivarox-FAR S.A., Le Locle (CH)

(72) Inventors: Marc Stranczl, Nyon (CH); Thierry Hessler, St-Aubin (CH); Jean-Luc Helfer, Le Landeron (CH)

(73) Assignee: Nivarox-FAR S.A., Le Locle (CH)

( * ) Notice: Subject to any disclaimer, the term of this patent is extended or adjusted under 35 U.S.C. 154(b) by 26 days.

This patent is subject to a terminal disclaimer.

(21) Appl. No.: 14/210,923

(22) Filed: Mar. 14, 2014

(65) Prior Publication Data

US 2014/0286145 A1 Sep. 25, 2014

(30) Foreign Application Priority Data

Mar. 19, 2013 (EP) ..... 13160025

(51) Int. Cl.

| | |
|---|---|
| ***G04B 17/32*** | (2006.01) |
| ***G04B 37/04*** | (2006.01) |
| ***G04B 18/02*** | (2006.01) |
| ***G04B 29/04*** | (2006.01) |
| ***G04B 35/00*** | (2006.01) |

(52) U.S. Cl.

CPC ..... *G04B 37/04* (2013.01); *G04B 18/025* (2013.01); *G04B 18/026* (2013.01); *G04B 29/04* (2013.01); *G04B 35/00* (2013.01)

(58) Field of Classification Search

CPC ..... G04B 17/32; G04B 17/325

See application file for complete search history.

(56) References Cited

U.S. PATENT DOCUMENTS

| | | | | |
|---|---|---|---|---|
| 7,059,764 | B2 * | 6/2006 | Hintze et al. | 368/127 |
| 8,240,910 | B2 * | 8/2012 | Orny et al. | 368/169 |
| 2003/0179655 | A1 * | 9/2003 | Scheufele | 368/127 |
| 2005/0073912 | A1 * | 4/2005 | Geyer | 368/127 |
| 2007/0091729 | A1 * | 4/2007 | Takahashi | 368/170 |
| 2007/0140065 | A1 * | 6/2007 | Levingston | 368/127 |
| 2009/0116343 | A1 * | 5/2009 | Levingston | 368/140 |
| 2010/0027382 | A1 * | 2/2010 | Daout et al. | 368/175 |
| 2011/0019506 | A1 | 1/2011 | Dehon | |
| 2012/0082010 | A1 * | 4/2012 | Boulenguiez et al. | 368/184 |
| 2012/0113765 | A1 | 5/2012 | Queval | |
| 2012/0176869 | A1 * | 7/2012 | Gonthier | 368/175 |
| 2012/0243386 | A1 * | 9/2012 | Semon | 368/129 |
| 2013/0064046 | A1 * | 3/2013 | Rochat | 368/177 |
| 2013/0070570 | A1 | 3/2013 | Colpo et al. | |

FOREIGN PATENT DOCUMENTS

| | | | |
|---|---|---|---|
| CH | 703 463 | A2 | 1/2012 |
| CH | 706 267 | A2 | 9/2013 |
| EP | 2 105 806 | A1 | 9/2009 |
| EP | 2 450 757 | A1 | 5/2012 |
| WO | WO 90/01731 | | 2/1990 |
| WO | WO 2011/120180 | A1 | 10/2011 |

OTHER PUBLICATIONS

European Search Report issued Oct. 28, 2013 in EP application 13160025, filed on Mar. 19, 2013 ( with English Translation).

* cited by examiner

*Primary Examiner* — Amy Cohen Johnson
*Assistant Examiner* — Jason Collins
(74) *Attorney, Agent, or Firm* — Oblon, McClelland, Maier & Neustadt, L.L.P.

(57) ABSTRACT

An inseparable single-piece timepiece component includes a position adjustable mechanism including a rigid structure carrying, with at least one resilient strip, a position adjustable component including a tooth arranged to cooperate with a toothed comb included in an adjustment mechanism. The adjustment mechanism is incorporated in this inseparable single-piece component.

17 Claims, 2 Drawing Sheets

INSEPARABLE SINGLE-PIECE TIMEPIECE COMPONENT

This application claims priority from European patent application No. 13160025.6 filed Mar. 19, 2013, the entire disclosure of which is hereby incorporated by reference.

FIELD OF THE INVENTION

The invention concerns an inseparable single-piece timepiece component including a position adjustable mechanism having a rigid structure carrying, by means of at least one resilient strip, a position adjustable component including an indexing means arranged to cooperate with a complementary indexing means comprised in an adjustment mechanism, said adjustment mechanism being incorporated in said inseparable single-piece component.

The invention also concerns a mechanical timepiece movement including at least one inseparable single-piece component of this type.

The invention concerns the field of timepiece mechanisms, and more specifically adjustments, particularly the adjustment of position or distance between centres.

BACKGROUND OF THE INVENTION

Adjusting the position fitting of timepiece components, in particular wheel set arbours, is always a difficult operation reserved for the most experienced professionals.

Movements are not always devised to facilitate position fitting or setting the distance between centres, to adjust gearings, the height of the wheel sets or to distribute any play.

EP Patent Application No 12161058.8 in the name of ETA SA discloses a movement devised for micrometric adjustment through a controlled movement of one end of an arbour. This micrometric mechanism requires a combination of finely adjusted components: eccentric screw, lever-lifting piece, which occupy space in the movement and involve significant cost.

It is therefore worthwhile to search for a mechanism architecture having a reduced number of components and moderate manufacturing costs, which is compact and not only permits fine adjustment to be performed, but achieves this without disturbing the geometry of the neighbouring components and maintains the adjustments once performed. This mechanism must also permit the holding means to be obscured during the adjustment phase, so as not to disrupt the mechanism.

CH Patent Application No 703463A2 in the name of NIVAROX discloses a balance with insert-free inertia adjustment, which includes a hooking means in a single-piece with the felloe arranged to cooperate with a complementary hooking means also in a single-piece with the felloe, both formed by toothed sectors with an inclined toothing.

EP Patent No 2450757 in the name of NIVAROX discloses an anti-trip mechanism with a moveable bistable assembly, preferably in a single-piece with the balance, and including a rotor fixed to the balance, and a bistable lever which is pivotably moveable relative to the rotor and pivots about an arbour parallel to and distinct from that of the rotor, one part of the trajectory of the bistable lever interfering with the balance pin. The connection between the rotor and the bistable lever is achieved, in a particular variant, by an elastic return means.

WO Patent Application No 90/01731A1 in the name of SKIDATA discloses a watch case including an open elastic loop type securing element, with a hook at the end cooperating with a notch comprised in the single-piece structure of the case.

WO Patent Application No 2011/120180A1 in the name of ROLEX discloses a clamping device for a toothed wheel, with elastic connecting elements in a single-piece with the structure. EP Patent Application No 2105806A1 in the name of GIRARD-PERREGAUX also discloses an escapement mechanism with a bistable strip spring in a single-piece with a structure in which it is mounted by buckling.

SUMMARY OF THE INVENTION

The invention proposes to provide a solution to this problem, with a reduced number of components and, if possible, with a single component, or better still a mechanism integrated in the component to be adjusted, or integrated in the structure receiving the component.

The solution must permit an assembly and adjustment of average complexity.

The present invention utilises, for this purpose, the new micro-component fabrication technologies, MEMS, "LIGA", lithography and suchlike, to make a multi-function mechanism, which ensures the aforementioned required functions.

The invention therefore concerns an inseparable single-piece timepiece component including a position adjustable mechanism having a rigid carrier structure, by means of at least one resilient strip, of a position adjustable component including an indexing means arranged to cooperate with a complementary indexing means comprised in an adjustment mechanism, said adjustment mechanism being incorporated in said inseparable single-piece component, characterized in that said complementary indexing means is mounted so as to be able to be uncoupled from the indexing means and can be clamped in a position of cooperation with said indexing means by a clamping mechanism moveable between at least one coupled position and at least one uncoupled position, distinct from said indexing means and said complementary indexing means, and resiliently secured to said structure.

According to a feature of the invention, said clamping mechanism is in turn subject to the action of a locking mechanism arranged to lock the clamping mechanism in a coupled position in which said clamping mechanism hinders said adjustment mechanism.

According to a feature of the invention, said clamping mechanism is in turn subject to the action of a locking mechanism arranged to maintain the clamping mechanism in an uncoupled position in which said adjustment mechanism is free.

According to a feature of the invention, said clamping mechanism is in turn subject to the action of a locking mechanism which either holds the clamping mechanism in an uncoupled position in which said adjustment mechanism is free, or locks it in a coupled position in which said clamping mechanism hinders said adjustment mechanism.

The invention also concerns a mechanical timepiece movement including at least one inseparable single-piece component of this type.

The advantage of a monolithic component is that it avoids assembly problems. The invention benefits from the precision with which these monolithic components are made (typically, the parts are for example made of silicon and therefore enjoy micrometric precision).

The monolithic mechanism has the main advantage of guaranteeing distances between centres and forming a ready-to-use mechanism.

The invention incorporates, in particular, flexible guide members, which have the following advantages:

guaranteed precision;

very reduced or zero friction level;

no hysteresis in the movements, due to the absence of friction or at least the extremely reduced level of friction;

no lubrication;

no play;

no wear.

The manufacture of the flexible guide members results in limitations, notably a limited travel, low return forces, and a limited charge. However, these limitations are not prohibitive for a number of horological functions, in particular those which relate to regulation.

These limitations are amply compensated for by the high precision of the distance between centres, the small number of components to be made and hence the reduced complexity and assembly time.

BRIEF DESCRIPTION OF THE DRAWINGS

Other features and advantages of the invention will appear upon reading the following detailed description, with reference to the annexed drawings, in which:

FIG. 1 illustrates the adjustment of a pivot for hooking a balance spring via an elastic adjustment means including a comb, the clamping in position of the comb in an adjusted position, and a locking mechanism controlling this clamping means.

FIG. 2 illustrates a similar example where the comb is held between two flexible strips and forms a bistable component.

FIG. 3 illustrates a similar mechanism with a comb immobilising an index located at the end of a flexible strip, the comb being pressed onto the index by a clamping strip-spring which is in turn immobilised by a locking finger.

DETAILED DESCRIPTION OF PREFERRED EMBODIMENTS

Figure 1:
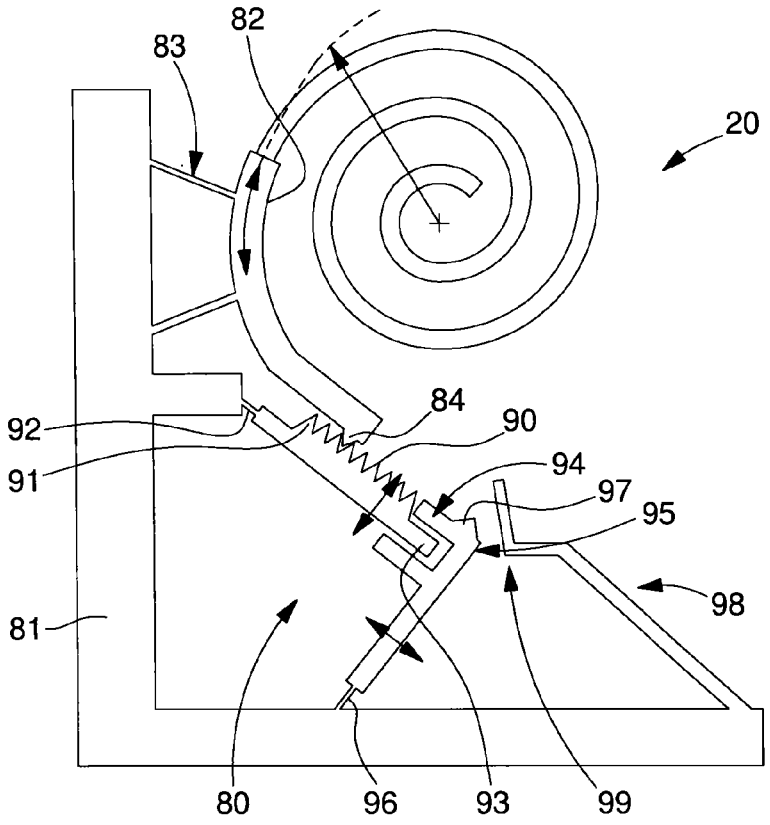
FIGS. 1 to 3 show a plan view of a monolithic assembly comprising a means of adjusting the position of a component which is also integrated in the assembly, said adjustment means being lockable in position by a clamping means.

The invention concerns the field of timepiece mechanisms, and more specifically adjustments, particularly the adjustment of position or distance between centres.

The invention concerns an inseparable single-piece timepiece component 20 including a position adjustable mechanism 80. This mechanism 80 includes a rigid structure 81 carrying, by means of at least one resilient strip 83, a position adjustable component 82 including an indexing means 84.

This indexing means 84 is arranged to cooperate with a complementary indexing means 91 comprised in an adjustment mechanism 90.

This adjustment mechanism 90 is incorporated in inseparable single-piece component 20.

According to the invention, complementary indexing means 91 is mounted so as to be able to be uncoupled from indexing means 84 and can be clamped in a position of cooperation with indexing means 84 via a clamping mechanism 94. This clamping mechanism 94 is moveable between at least one coupled position and at least one uncoupled position. This clamping mechanism 94 is distinct from indexing means 84 and from complementary indexing means 91 and is resiliently secured to structure 81.

Advantageously, clamping mechanism 94 is in turn subject to the action of a locking mechanism 98 as shown in the Figures.

This locking mechanism 98 is arranged to lock clamping mechanism 94 in a coupled position in which clamping mechanism 94 hinders adjustment mechanism 90.

Preferably, clamping mechanism 94 is in turn subject to the action of a locking mechanism 98 arranged to hold the clamping mechanism in an uncoupled position in which adjustment mechanism 90 is free.

In a combined embodiment, shown in FIG. 1, clamping mechanism 94 is in turn subject to the action of a locking mechanism 98 which either holds mechanism 94 in an uncoupled position in which adjustment mechanism 90 is free, or locks it in a coupled position in which clamping mechanism 94 hinders adjustment mechanism 90.

According to the invention, locking mechanism 98 is also resiliently secured to structure 81 and is moveable between the two uncoupled and coupled positions where it holds or locks clamping mechanism 94.

Preferably, complementary indexing means 91 of adjustment mechanism 90 are attached to rigid structure 81 by at least one resilient flexible strip 92.

Figure 2:
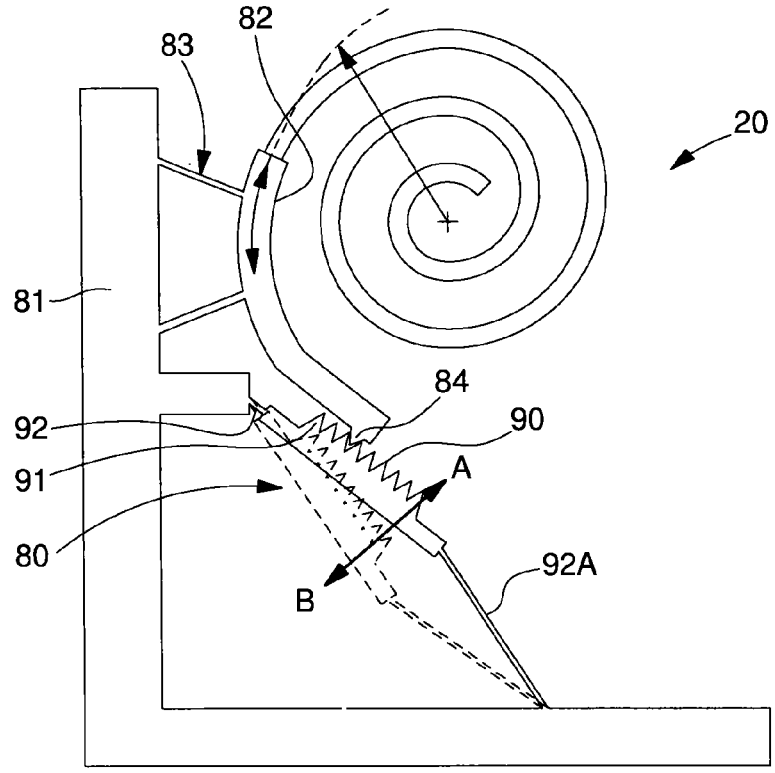

In the particular embodiment of FIG. 2, complementary indexing means 91 of adjustment mechanism 90 is attached to rigid structure 81 in a suspended manner between at least a first resilient flexible strip 92 and a second resilient flexible strip 92A. The assembly forms a bistable element able to occupy two stable positions, a first activated position A where complementary indexing means 91 cooperates with indexing means 84, and a second release position B where means 91 is uncoupled. Adjustment mechanism 90 thus itself forms a clamp as a result of its bistable behaviour, and locking means are not essential.

In a particular embodiment such as that of FIG. 2, the first elastic flexible strip 92 and the second elastic flexible strip 92A are substantially aligned, and together form a bistable element which operates by buckling.

In another embodiment which is not illustrated in the Figures, complementary indexing means 91 is attached to a rigid structure 81 in a suspended manner between more than two flexible resilient strips, the assembly forming a bistable or multi-stable element able to occupy at least two stable positions, a first activated position A where complementary indexing means 91 cooperates with indexing means 84, and a second release position B where it is uncoupled therefrom. In a particular variant, these strips, of which there are more than two, are not collinear.

Generally, the position adjustable mechanism 80 finds a particularly advantageous application for pre-stressing a flexible element, such as a multi-stable resilient element, or a bistable strip which operates by buckling.

Clamping mechanism 94 is preferably attached to rigid structure 81 by at least one resilient flexible strip 96.

In a particular embodiment illustrated in FIG. 1, complementary indexing means 91 includes at least one arm 93, which is arranged to cooperate with a fork comprised in clamping mechanism 94.

Clamping mechanism 94 may occupy a first clamping position where the clearance of arm 93 is limited by the fork under the return action of this at least one resilient flexible strip 96, and a second release position where the clearance of arm 93 is not hindered by the fork and where clamping mechanism 94 is moved away from its clamping position against resilient flexible strip 96.

In a non-limiting manner and as illustrated by the Figures, complementary indexing means 91 advantageously includes at least one toothed comb, or respectively at least one tooth, arranged to cooperate, in different indexing positions, with at least one tooth 84, respectively at least one toothed comb, comprised in position adjustable component 82.

Preferably, to facilitate the relative blocking between component 82 and the complementary indexing means:

- either complementary indexing means 91 is moveable in an angular pivoting movement relative to structure 81 for the release of said means 91 relative to position adjustable component 82,
- or position adjustable component 82 is moveable in an angular pivoting movement relative to structure 81 for the release of said component 82 relative to complementary indexing means 91,
- or both complementary indexing means 91 and position adjustable component 82 are moveable in an angular pivoting movement relative to structure 81 for the relative disengagement thereof from each other.

Figure 3:
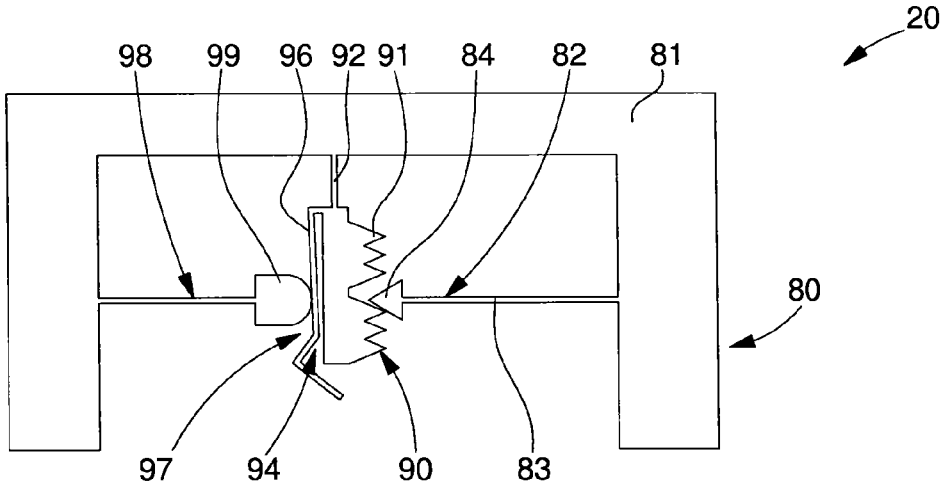

In the particular embodiment of FIG. 3, complementary indexing means 91 includes at least one toothed comb immobilising at least one tooth 84 which is comprised in position adjustable component 82 and located at the end of at least one flexible strip 83. The toothed comb is pressed onto said at least one tooth 84 by a locking strip spring 96 belonging to clamping mechanism 94. Locking mechanism 98 includes a locking finger 99 mounted on at least one flexible strip 98. Locking strip spring 96 is immobilised by locking finger 99 cooperating with an arresting surface 97 of locking strip spring 96.

In a particular embodiment, inseparable single-piece component 20 includes severable elements intended to facilitate the assembly of the component in a larger assembly, the severable elements then only need to be broken off to give one or more degrees of freedom to some of its constituent parts. In a particular embodiment, as shown in FIGS. 1 and 2, position adjustable component 82 is a means of guiding or of holding a component to be guided or a balance spring, and the component to be guided or balance spring is in a single-piece with inseparable single-piece component 20. In this example of FIGS. 1 and 2, component 82 is a retaining stud for the outer coil of a balance spring of a sprung balance assembly of an escapement mechanism.

Advantageously, inseparable single-piece component 20 is made in one of the new micro-component fabrication technologies, MEMS, "LIGA", lithography and suchlike to make a multi-function mechanism, ensuring the aforementioned required functions. In a particular non-limiting embodiment, the component is made of silicon, and the integrated elastic return means comprised therein is pre-stressed in a silicon oxide state.

The invention also concerns a mechanical timepiece movement 100 including at least one inseparable single-piece component 20 of this type.

What is claimed is:

1. An inseparable single-piece timepiece component comprising:

a position adjustable mechanism including a rigid structure carrying, by at least one resilient strip, a position adjustable component including an indexing structure arranged to cooperate with a complementary indexing structure comprised in an adjustment mechanism, said adjustment mechanism being incorporated in said inseparable single-piece component, wherein said complementary indexing structure is mounted so as to be uncouplable from the indexing structure and clampable in a position of cooperation with said indexing structure by a clamping mechanism moveable between at least one coupled position and at least one uncoupled position, distinct from said indexing structure and said complementary indexing structure and resiliently secured to said rigid structure.

2. The inseparable single-piece component according to claim 1, wherein said clamping mechanism is in turn subject to an action of a locking mechanism which either holds the clamping mechanism in the at least one uncoupled position in which the adjustment mechanism is free, or locks the clamping mechanism in the at least one a coupled position in which said clamping mechanism hinders said adjustment mechanism.

3. The inseparable single-piece component according to claim 2, wherein said locking mechanism is also resiliently secured to said rigid structure, and is moveable between the two uncoupled and coupled positions where the locking mechanism locks said clamping mechanism.

4. The inseparable single-piece component according to claim 2, wherein said clamping mechanism is attached to said rigid structure by at least one resilient flexible strip.

5. The inseparable single-piece component according to claim 4, wherein said complementary indexing structure includes at least one arm arranged to cooperate with a fork comprised in said clamping mechanism, and said clamping mechanism is occupiable in a first clamping position where a clearance of said arm is limited by said fork under a return action of said at least one resilient flexible strip, and a second release position where the clearance of said arm is not hindered by said fork and where said clamping mechanism is moved away from the first clamping position thereof against said at least one resilient flexible strip.

6. The inseparable single-piece component according to claim 2, wherein said complementary indexing structure includes at least one toothed comb that immobilizes at least one tooth which is comprised in said position adjustable component and located at an end of at least one flexible strip, said toothed comb being pressed onto said at least one tooth by a clamping strip spring belonging to said clamping mechanism, said locking mechanism includes a locking finger mounted on at least one flexible strip, and said clamping strip spring is immobilized by said locking finger cooperating with an arresting surface of said clamping strip spring.

7. The inseparable single-piece component according to claim 1, wherein said clamping mechanism is in turn subject to an action of a locking mechanism arranged to lock the clamping mechanism in the at least one coupled position in which said clamping mechanism hinders said adjustment mechanism.

8. The inseparable single-piece component according to claim 1, wherein said clamping mechanism is in turn subject to an action of a locking mechanism arranged to hold the clamping mechanism in the at least one uncoupled position in which said adjustment mechanism is free.

9. The inseparable single-piece component according to claim 1, wherein said complementary indexing structure of said adjustment mechanism is attached to said rigid structure by at least one resilient flexible strip.

10. The inseparable single-piece component according to claim 9, wherein said complementary indexing structure of said adjustment mechanism is attached to said rigid structure in a suspended manner between at least a first resilient flexible strip and a second resilient flexible strip, an assembly of which forms a bistable element that is occupiable in two stable positions, a first activated position where said complementary indexing structure cooperates with said indexing structure, and a second release position where said complementary indexing structure is uncoupled therefrom.

11. The inseparable single-piece component according to claim 10, wherein said first resilient flexible strip and said second resilient flexible strip are substantially aligned, and together form the bistable element which operates by buckling.

12. The inseparable single-piece component according to claim 10, wherein said complementary indexing structure of said adjustment mechanism is attached to said rigid structure in a suspended manner between more than two resilient flexible strips, an assembly of which forms a bistable or multistable element that is occupiable in at least two stable positions, a first activated position where said complementary indexing structure cooperates with said indexing structure, and a second release position where said complementary indexing structure is uncoupled therefrom.

13. The inseparable single-piece component according to claim 1, wherein said complementary indexing structure includes at least one toothed comb, or respectively at least one tooth, arranged to cooperate, in different indexing positions, with at least one tooth, or respectively at least one toothed comb, comprised in said position adjustable component.

14. The inseparable single-piece component according to claim 13, wherein, either said complementary indexing structure is moveable in an angular pivoting motion relative to said rigid structure for a release thereof relative to said position adjustable component, or said position adjustable component is moveable in an angular pivoting motion relative to said rigid structure for a release thereof relative to said complementary indexing structure, or both said complementary indexing structure and said position adjustable component are moveable in an angular pivoting motion relative to said rigid, structure for a relative release thereof from each other.

15. The inseparable single-piece component according to claim 1, wherein said position adjustable component is a guide or a holder of a component to be guided or a balance spring, and said component to be guided or balance spring is in a single-piece with said inseparable single-piece component.

16. The inseparable single-piece component according to claim 1, wherein the inseparable single-piece component is made of silicon, and an integrated elastic return mechanism comprised therein is pre-stressed in a silicon oxide state.

17. A mechanical timepiece movement comprising at least one inseparable single-piece component according to claim 1.

* * * * *